US006233748B1

(12) United States Patent
Gieger et al.

(10) Patent No.: US 6,233,748 B1
(45) Date of Patent: May 22, 2001

(54) ENVIRONMENTAL PROTECTION SYSTEM

(75) Inventors: Paul Daniel Gieger, Pomona; Peter A. Barnett, Costa Mesa, both of CA (US)

(73) Assignee: Integrated Medical Systems, Inc., Signal Hill, CA (US)

( * ) Notice: Subject to any disclaimer, the term of this patent is extended or adjusted under 35 U.S.C. 154(b) by 0 days.

(21) Appl. No.: 09/127,356

(22) Filed: Jul. 31, 1998

(51) Int. Cl.[7] ..... A42B 3/00; A62B 18/00

(52) U.S. Cl. ..... 2/410; 2/6.6; 128/201.25; 128/205.27; 588/212

(58) Field of Search ..... 2/410, 411, 412, 2/457, 6.6; 128/201.25, 205.27, 206.17; 588/212, 222, 225, 243, 247; 204/157.44, 157.63; 423/245.1, 245.3

(56) References Cited

U.S. PATENT DOCUMENTS

| | | | | |
|---|---|---|---|---|
| 3,078,845 | | 2/1963 | Kohlmeyer | 128/141 |
| 4,266,301 | | 5/1981 | Canda | 2/410 |
| 4,676,236 | | 6/1987 | Piorkowski et al. | 128/201.23 |
| 4,870,959 | | 10/1989 | Reisman et al. | 128/201.25 |
| 4,954,465 | * | 9/1990 | Kawashima et al. | 502/5 |
| 4,966,759 | * | 10/1990 | Robertson et al. | 422/186 |
| 5,045,288 | * | 9/1991 | Raupp et al. | 422/186.3 |
| 5,078,130 | * | 1/1992 | Van Oosten et al. | 128/201.24 |
| 5,146,757 | * | 9/1992 | Dearing | 62/61 |
| 5,165,395 | * | 11/1992 | Ricci | 128/202.22 |
| 5,302,356 | * | 4/1994 | Shadman et al. | 422/186.3 |
| 5,308,454 | * | 5/1994 | Anderson | 204/59 R |
| 5,318,018 | | 6/1994 | Puma et al. | 128/202.11 |
| 5,449,443 | * | 9/1995 | Jacoby et al. | 204/157.3 |
| 5,505,904 | | 4/1996 | Haidinger et al. | 422/24 |
| 5,593,737 | * | 1/1997 | Meinzer et al. | 427/512 |
| 5,744,407 | * | 4/1998 | Tabatabaic-Raissi et al. | 442/121 |
| 5,753,106 | * | 5/1998 | Schenck | 210/96.1 |
| 5,758,639 | * | 6/1998 | Ikonen | 128/201.25 |
| 5,862,167 | * | 1/1999 | Sassa et al. | 372/45 |
| 5,865,959 | * | 2/1999 | Meinzer et al. | 204/157.3 |
| 5,866,752 | * | 2/1999 | Goozner | 588/227 |

FOREIGN PATENT DOCUMENTS

2252707 * 8/1992 (GB) .

OTHER PUBLICATIONS

Heterogeneous Photocatalytic Oxidation of Gas–Phase Organics for Air Purification: Acetone, 1–Butanol, Butyraldehyde, Formaldehyde, and m–Xylene oxidation. Jose Peral and David F. Ollis, pp. 554–564 of The Journal of Catalysis. 1992.*

The First Internationl Conference On TiO2 Photocatalytic Purification And treatment of Water and Air, 1992.*

Supported titania for photodegradation. Zeltner, Hill, Jr. and Anderson.*

Kinetic Studies in Heterogenous Pgotocatalysis. !. Photocatalytic Degradation of Clorinated Phenols In aerated Aqueous Solutions over TiO2 Supported on a Glass Matrix from The Journal of Physical Chemistry, 1988.*

Photocatalysis Over TiO2 supported on a Glass Substrate from Solar Energy Materials, 1986.* development and Optimization of a TiO2–Coated Fiber Optic Cable Reactor: Photocatalytic Degradation of 4–Chlorophenol by Peill and Hoffman, 1995.*

* cited by examiner

*Primary Examiner*—Michael A. Neas
(74) *Attorney, Agent, or Firm*—Stetina Brunda Garred & Brucker

(57) ABSTRACT

An environmental protection system for rendering biological/chemical agents harmless has a source of radiation such as an ultraviolet light source, which is configured to irradiate a reactive surface, such as one formed of titanium dioxide. The reactive surface has an oxidation potential sufficient to cooperate with the source of radiation so as to render harmless biological/chemical agents in contact with the reactive surface.

12 Claims, 1 Drawing Sheet

ENVIRONMENTAL PROTECTION SYSTEM

FIELD OF THE INVENTION

The present invention relates generally to biological/chemical filtering systems and more particularly to a personal environmental protection system for rendering airborne biological/chemical agents harmless.

BACKGROUND OF THE INVENTION

The use of biological and chemical agents in warfare is well-known. Such biological and chemical agents may be dispersed in the air where enemy troops are present in an attempt to incapacitate or kill the enemy troops.

One common countermeasure against such biological and chemical agents is the use of a gas mask, which typically utilizes particulate and chemical filtering. Activated charcoal i.e., carbon, is the typical filtering agent. Protective clothing may also be worn so as to prevent absorption of biological and chemical agents through the skin.

However, for such a contemporary gas mask and protective clothing to be effective, it must be worn prior to exposure to the biological and/or chemical agent. Even under ideal conditions, where a biological/chemical agent detector is co-located with the targeted troops, a soldier frequently does not have time to don such contemporary protective gear. Thus, by the time the soldier has been warned, he may already have inhaled a lethal quality of the toxin or pathogen.

It is also known to inoculate soldiers against biological agents. However, in many instances the concentration of biological agent will be so high that current vaccines are not capable of providing adequate protection thereagainst. Inoculation against chemical agents is typically not possible.

Moreover, contemporary filters provide inadequate protection against some modern toxic chemical agents as well as the more virulent infectious agents such as anthrax.

As such, it is desirable to provide a reliable and effective means for neutralizing toxic chemicals and/or pathogens which is easy to use and very quick to put into service.

SUMMARY OF THE INVENTION

The present invention specifically addresses and eliminates the above mentioned deficiencies in the prior art. More particularly, the present invention comprises an environmental protection system for rendering biological/chemical agents harmless. The environmental protection system comprises a source of radiation and a reactive surface, wherein the reactive surface has an oxidation potential sufficient to cooperate with the source of radiation in a manner which renders biological/chemical agents which are in contact with the reactive surface harmless. The source of radiation and the reactive surface are preferably configured for attachment to a helmet having an airtight transparent face plate, so as to make safe air which is breathed by the wearer of the helmet. By incorporating the environmental protection system into a helmet, which is always worn by soldiers upon the battlefield, the environmental protection system of the present invention is always ready for use.

More particularly, the helmet, which incorporates the environmental protection system of the present invention, may be worn without the removable transparent face shield or visor, if desired. Then, when a biological/chemical warning is sounded, the face shield is quickly and easily installed upon the helmet so as to provide an airtight seal. This minimizes the actions which are necessary in order to provide protection from biological/chemical agents (as compared to the procedure for donning a contemporary gas mask), thereby substantially enhancing a soldier's likelihood of surviving a biological/chemical attack. Of course, if the soldier leaves the face shield in place on the helmet and the ultraviolet light source is already turned on, then the environmental protection system is ready to provide protection from a biological/chemical attack without any further action by the soldier. If the ultraviolet light source is turned off, then it must be turned on, either automatically or manually. The ultraviolet light source may optionally be turned on automatically via a radio signal or the like transmitted in response to the sounding of a biological/chemical warning.

Optionally, the environmental protection system of the present invention is configured such that when any soldier within a predetermined area activates his environmental protection system, then a warning is sounded and/or all of the environmental protection systems of all nearby soldiers are automatically activated, such as by a radio signal, for example. Although the environmental protection systems of the soldiers may be activated by radio, for example, they must be manually deactivated, so as to prevent deactivation by an enemy. If a soldier's face shield has been removed, then an audible and/or visual alarm provides an indication of the need to immediately install the face shield and also of the need to activate the ultraviolet light source, if necessary. In this manner, all of the personal environmental systems of a friendly force can be activated in the shortest time possible when a biological/chemical attack is suspected.

The source of radiation preferably comprises a source of ultraviolet radiation and the reactive surface preferably comprises titanium dioxide. According to the preferred embodiment of the present invention, the reactive surface comprises a plurality of optical quartz fibers upon which the titanium dioxide is formed and the source of radiation is configured so as to direct ultraviolet radiation into the quartz fibers, thereby illuminating the titanium dioxide surface coating thereof.

The source of radiation preferably comprises a solid-state ultraviolet light source, preferably a gallium nitride diode which emits ultraviolet light having a wavelength between approximately 300 nm and approximately 400 nm.

Preferably, the reactive surface comprises titanium dioxide formed upon optical quartz fibers having a length between approximately 10 cm and approximately 100 cm and having a diameter between approximately 10 microns approximately 50 microns.

A self-sterilizing surface may be formed by applying a coating of titanium dioxides thereto. Where the surface is exposed to sufficient sunlight, no other source of illumination may be necessary. Otherwise, a source of ultraviolet radiation is preferably provided so as to illuminate the self-sterilizing surface.

According to the preferred embodiment of the present invention, the helmet, as well as any other desired clothing or surfaces, is formed to have a layer of porous, substantially ultraviolet light transparent material formed upon a layer of titanium dioxide which substantially covers the helmet or other surface.

The layer of porous ultraviolet light transparent material provides a protective coating for the underlying titanium dioxide, such that the underlying titanium dioxide does not easily become scratched or abraded. The layer of porous, substantially ultraviolet light transparent material preferably comprises a ceramic material.

Thus, the source of radiation and the reactive surface are configured so as to render the biological/chemical agents coming into contact therewith harmless, such that breathing and/or touching the biological/chemical agents does not incapacitate a soldier.

Thus, according to the preferred embodiment of the present invention, a helmet comprises an optical fiber reactor and, the optical fiber reactor comprises a source of ultraviolet radiation and a reactive surface which comprises titanium dioxide upon which the ultraviolet radiation is directed. The helmet also comprises an air intake manifold configured so as to route outside air through the optical fiber reactor and into the helmet such that the air is thus rendered safe for breathing.

Self-sterilizing surfaces are fabricated by forming a titanium dioxide layer upon the surface and then forming a layer of porous substantially ultraviolet light transparent material, preferably a ceramic material thereupon. Ultraviolet radiation, such as that of sunlight, incident upon the titanium dioxide layer effects oxidation of harmful biological/chemical agents disposed upon the surface.

The helmet preferably further comprises a removable transparent face shield; a fluid intake port configured to facilitate the drinking of fluids without allowing the fluids to become contaminated; a laser rangefinder; night vision enhancement; a heads-up display; weapons sighting and control circuitry; a voice activated radio; facial armor; eye laser protection; noise cancellation circuitry; and auditory enhancement circuitry.

These, as well as other advantages of the present invention will be more apparent from the following description and drawings. It is understood that changes in the specific structure shown and described may be made within the scope of the claims without departing from the spirit of the invention.

DETAILED DESCRIPTION OF THE PREFERRED INVENTION

The detailed description set forth below in connection with the appended drawings is intended as description of the presently preferred embodiment of the invention and is not intended to represent the only form in which the present invention may be constructed or utilized. The description sets forth the functions and the sequence of steps for constructing and operating the invention in connection with the illustrated embodiment. It is to be understood, however, that the same or equivalent functions and sequences may be accomplished by different embodiments that are also intended to be encompassed within the spirit and scope of the invention.

Figure 1:
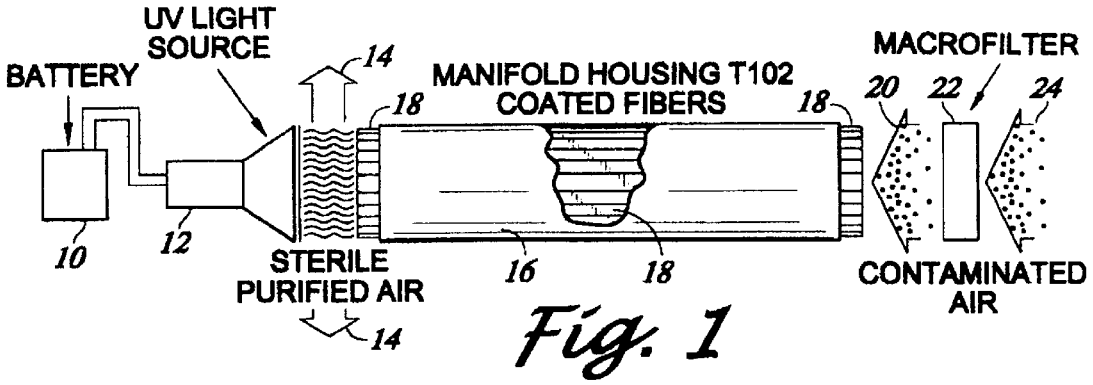
FIG. 1 is a schematic representation of the environmental protection system of the present invention showing air flowing through a manifold containing titanium dioxide coated optical quartz fibers which are illuminated with an ultraviolet light source.

Referring down to FIG. 1, the present invention generally comprises a plurality of titanium dioxide coated optical quartz fibers which are illuminated by an ultraviolet light source 10. Biological/chemical agents present in air flowing proximate the fibers 18 are rendered harmless as they contact the titanium dioxide surface and are rapidly oxidized.

As those skilled in the art will appreciate, ultraviolet light effects the oxidation of many chemical substances and/or biological agents, particularly when in the presence of a suitable catalyst such as titanium dioxide. Thus, by irradiating undesirable toxins and/or biological agents with ultraviolet radiation, those chemical and/or biological agents which contact the catalyst, i.e., titanium dioxide, rapidly combine with oxygen, i.e., are oxidized such that the biological agents are killed and the chemical agents or toxins are rendered ineffective or harmless.

Although such oxidation may occur to a much lesser degree when the biological and/or chemical agents are irradiated with ultraviolet light and when no catalyst is present, the use of such a catalyst, i.e., titanium dioxide, substantially enhances the rate at which such oxidation occurs. As those skilled in the art will appreciate, it is crucial that substantially all of the biological and/or chemical agents be rendered safe when air containing such agents is to be breathed by a person. As such, it is important to optimize the rate at which such oxidation occurs. By providing a highly effective catalyst, such as titanium dioxide, the rate at which such oxidation takes place is substantially enhanced.

More particularly, according to the present invention contaminated air 24 containing a high concentration of bacterial/chemical agents is first pre-filtered via macro filter 22 to remove those particulates which are susceptible to mechanical filtering. The pre-filtered air 20 is then caused to flow around of the titanium dioxide coated optical quartz fibers 18 by forcing it through manifold 16. Ultraviolet light source 12 preferably comprises a gallium nitride diode which emits ultraviolet approximately 400 nm. The ultraviolet light source illuminates the polished ends of the optical quartz fibers 18 such that ultraviolet light is transmitted substantially throughout the length of each optical quartz fiber 18. Battery 10 provides electrical power to the ultraviolet light source 12. Clean air 14 exits the manifold 16 and is suitable for breathing.

Specifically, the high concentration of airborne biological/chemical agents disposed in the contaminated air 24 may be mitigated by the macrofilter 22. In other words, the macrofilter 22 filters the agents disposed in the airstream of contaminated air 24 flowing therethrough. Such removal of agents lessens the concentration thereof in the airstream of pre-filtered air 20 ready for further filtration by the optical quartz fibers 18. Therefore, such multistage approach may be advantageous in acquiring breathable air in the sense that the agents in a first portion of the airstream, namely, the contaminated air 24, are greatly abated in a second portion of the airstream, namely, the pre-filtered air 20, for eventual elimination thereof.

As those skilled in the art appreciate, the quartz optical fiber's 18, which are packed into manifold 16, define a plurality of air paths of therebetween. Thus, as contaminated air travels between the titanium dioxide coated outer surfaces of the optical quartz fibers, the contaminants disposed in the air contact the titanium dioxide and consequently become oxidized.

Figure 2:
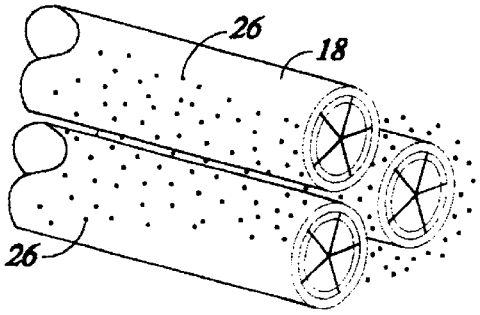
FIG. 2 is an enlarged perspective view of three of the titanium dioxide coated optical quartz fibers of FIG. 1, showing the destruction, i.e., rendering safe, of airborne pathogens as they come into contact with the titanium dioxide surface when air flows between the titanium dioxide coated optical quartz fibers.

Referring now to FIG. 2, pathogens 26 which contact to the titanium dioxide surface of optical quartz fibers 18 are neutralized by the rapid oxidation thereof.

Figure 4:
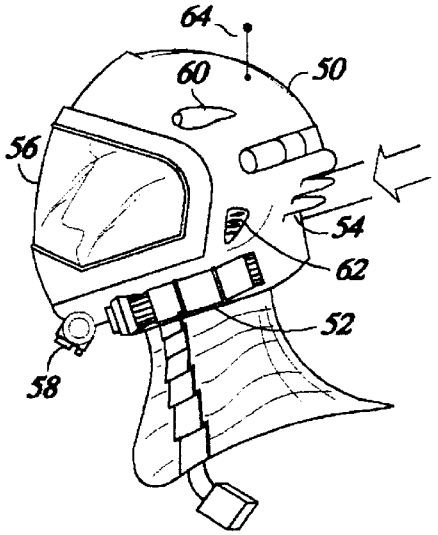
FIG. 4 is a side view of a helmet having an optical fiber reactor formed thereon according to the present invention.

Referring up to FIG. 4, according to the preferred embodiment of the present invention, a helmet 50 comprises an optical fiber reactor 52. The optical fiber reactor 52 is defined by the manifold 16, optical quartz fibers 18 and ultraviolet light source 12 of FIG. 1. Thus, the optical fiber reactor 52 provides a source of clean, uncontaminated air to the wearer of the helmet.

According to the preferred embodiment of the present invention, air intake 54 of the helmet 50 provides a source of air for the optical fiber reactor 52.

Easily removable transparent face shield 56 is wrapped substantially around the helmet 50, thereby enhancing peripheral vision and mitigating any feeling of claustrophobia. The helmet 50 is always worn in the battlefield, so as to protect the user's head from injury. The removable transparent face shield 56 may either be worn or stored. When the removable face shield 56 is worn, then the environmental protection system of the present invention is ready for immediate use in rendering biological/chemical agents harmless. When the transparent face shield 56 is already installed upon the helmet 50, then it is only necessary to activate the ultraviolet light source 12 in order for the environmental protection system to function.

When the removable transparent face shield 56 is stored, then it must be attached to the helmet 56 so as to seal the wearer from any biological/chemical agents present in the air. Again, the ultraviolet light source 12 must be activated.

However, in either instance protection is provided substantially faster than when a gas mask must be donned. As those skilled in the art will appreciate, removing a contemporary gas mask from its storage pouch and placing it correctly upon a soldier's face is a comparatively time consuming and complex process. The gas mask must be worn properly so that an adequate seal is provided. Thus, the gas mask must be positioned properly upon the wearer's face and the straps associated therewith tightened sufficiently to effect an adequate seal. It is not unusual for a contemporary gas mask to be worn improperly, thus resulting in the undesirable inhalation of airborne contaminants and the consequent incapacitation or death of the soldier.

The transparent face shield preferably further comprises a head-up display. Fluid intake port 58 is configured so as to facilitate drinking of fluids without the fluids becoming contaminated.

According to the preferred embodiment of the present invention, the helmet 50 further comprises laser rangefinder, night vision enhancement, and weapon sighting control circuitry, 60. Preferably, the transparent face comprises laser eye protection, i.e., a filter which mitigates the transmission of laser modulation. Noise cancellation circuitry and/or auditory enhancement circuitry 62 enhances the user's hearing. Voice actuated radio 64 facilitates communications with other personnel.

Figure 3:
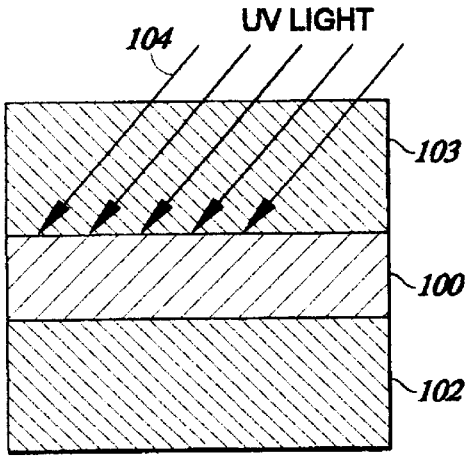
FIG. 3 is a side view showing ultraviolet radiation being transmitted through a porous, substantially ultraviolet transparent ceramic top layer to be absorbed by the titanium dioxide layer therebeneath, thereby forming a self sterilizing surface upon the bottom layer, which may be defined by a helmet, other articles of protective clothing, etc.

Referring now the FIG. 3, the helmet, as well as any other desired portion of the protective suit, preferably comprises a self-sterilizing material formed by disposing a layer of titanium dioxide 100 upon the outer surface of the helmet 102 or upon the outer surface of any other desired material. A layer of porous ultraviolet transparent material, preferably ceramic 103, is formed upon the titanium dioxide layer 100. The ceramic material 103 forms a protective coating for the titanium dioxide 100, so as to mitigate abrasion, scratching, or wearing thereof. Ultraviolet light 104, such as that present in sunlight, effects the oxidation of harmful contaminants, i.e., biological/chemical agents which contact the titanium dioxide coating of the helmet or other surface.

It is understood that the exemplary environmental protection system described herein and shown in the drawings represents only a presently preferred embodiment of the invention. Indeed, various modifications and additions may be made to such embodiment without departing from the spirit and scope of the invention. For example, the quartz optical fibers need not be generally straight fibers having a circular cross section. Those skilled in the art will appreciate that the fibers may be curved in any desired manner and that the cross section thereof may be of any desired shape. Further, the optical fiber reactor 52 may be of any desired shape, configuration, and may be disposed at any desired location and need not be fixedly attached to the helmet 50. Thus, these and other modifications and additions may be obvious to those skilled in the art and may be implemented to adapt the present invention for use in a variety of different applications.

What is claimed is:

1. A serial multistage protective helmet for mitigating airborne biological/chemical agents disposed in an airstream flowing therethrough, the helmet comprising:

(a) an air intake manifold for advancing the airstream therethrough;

(b) a macrofilter disposed adjacent the manifold, the macrofilter being configured to filter a first portion of the agents from the airstream; and (c) an optical fiber reactor disposed downstream of the macrofilter and comprising:

(1) a plurality of optical quartz fibers each layered with titanium dioxide forming a reactive surface; and (2) a source of radiation disposed proximate the surface, the source of radiation being configured to illuminate the reactive surface;

(3) wherein the reactive surface is provided with an oxidation potential such that, upon exposure of the surface to the source of radiation, a second portion of the agents are filtered from the airstream.

2. The helmet as set forth in claim 1 further comprising a laser rangefinder.

3. The helmet as set forth in claim 1 further comprising a heads-up display.

4. The helmet as set forth in claim 1 further comprising a voice activated radio.

5. The helmet as set forth in claim 1 further comprising an eye laser protection.

6. The helmet as set forth in claim 1 further comprising an auditory enhancement circuitry.

7. The helmet as set forth in claim 1 further comprising a removable transparent face shield.

8. The helmet as set forth in claim 1 further comprising a fluid intake port configured to facilitate safe drinking of fluids.

9. The helmet as set forth in claim 1 further comprising a night vision enhancement.

10. The helmet as set forth in claim 1 further comprising a weapons sighting and control circuitry.

11. The helmet as set forth in claim 1 further comprising facial armor.

12. The helmet as set forth in claim 1 further comprising a noise cancellation circuitry.

* * * * *